United States Patent [19]

Eissler

[11] 4,065,035

[45] Dec. 27, 1977

[54] POURING FITMENT FOR METAL TOPPED CONTAINER

[75] Inventor: John C. Eissler, Drexel Hill, Pa.

[73] Assignee: Crown Cork & Seal Company, Inc., Philadelphia, Pa.

[21] Appl. No.: 704,322

[22] Filed: July 12, 1976

Related U.S. Application Data

[63] Continuation of Ser. No. 475,981, June 3, 1974.

[51] Int. Cl.[2] ..... B65D 25/42

[52] U.S. Cl. ..... 222/153; 220/306; 220/375; 222/543; 222/569

[58] Field of Search ..... 220/67, 269, 270, 306–310, 220/354–356, 375; 222/543, 569, 570, 153; 113/1 H, 120 P, 121 E

[56] References Cited

U.S. PATENT DOCUMENTS

| | | | |
|---|---|---|---|
| 2,173,571 | 9/1939 | Jesnig | 222/569 |
| 3,101,878 | 8/1963 | Bee | 222/543 X |
| 3,117,703 | 1/1964 | Henchert | 222/569 X |
| 3,128,900 | 4/1964 | Chaboche | 222/270 |
| 3,307,752 | 3/1967 | Anderson | 222/569 X |
| 3,358,875 | 12/1967 | Ekstrom | 220/306 |

FOREIGN PATENT DOCUMENTS

| | | | |
|---|---|---|---|
| 597,021 | 4/1960 | Canada | 222/570 |
| 1,534,069 | 7/1968 | France | 22/569 |

*Primary Examiner*—Robert B. Reeves
*Assistant Examiner*—David A. Scherbel
*Attorney, Agent, or Firm*—Woodcock, Washburn, Kurtz & Mackiewicz

[57] ABSTRACT

A plastic, child-proof fitment is inserted into the opening in a panel of a metallic container. An upwardly extending bead having a burr at the radially innermost edge thereof surrounds the opening and is received by a downwardly extending groove in the plastic fitment. The radially innermost side of the groove includes a radially outwardly extending protuberance which is fittingly engaged by the burr.

4 Claims, 10 Drawing Figures

POURING FITMENT FOR METAL TOPPED CONTAINER

This is a continuation of application Ser. No. 475,981 filed June 3, 1974.

BACKGROUND OF THE INVENTION

This invention relates to containers adapted to receive plastic closure fitments including fitments which are designed to resist opening by children.

A typical container-closure combination of this type is shown in FIG. 1. The container or can 10 includes an uppermost metallic panel 12 having an opening receiving a plastic fitment 14. As illustrated, the fitment 14 is of the child-proof or child-resistant type so as to require a substantial torque about the axis of the closure (indicated by the arrow A) and a force upwardly and along the axis of the closure (as depicted by the arrow B). Many different types of products are kept in this type of container to protect young children from the harmful effects of these products.

An enlarged prior art child-resistant closure in combination with the metallic container panel 12 is shown in FIGS. 2 and 3. The closure 14 comprises an annular portion 16 extending generally downwardly in a direction substantially parallel to the axis of the closure $x—x$. The annular portion includes a radially outwardly extending protuberance 18 in the form of an annular ridge. The closure 14 further comprises a flange 20 extending radially outwardly from the annular portion above the protuberance 18. The flange 20 includes a downwardly extending projection in the form of annular ring 22 spaced radially outwardly from the annular portion 16 so as to form an annular groove 24 between a radially inwardly facing surface 26 and a radially outwardly facing surface 28. Generally speaking, the inwardly facing surface 26 and the outwardly facing surface 28 are concentric, generally cylindrical surfaces.

The closure 14 includes an annular neck 30 extending upwardly from the flange 20 where the central portion of the neck 30 includes one or more dispensing openings 32. The periphery of the neck 30 around the dispensing opening 32 comprises an annular lip 34 adapted to cooperate with a radially inwardly extending ridge 36 of a closure cap 38 so as to hold the cap 38 in place on the base of the closure 14. The ridge 36 extends around approximately 300° of the cap periphery and includes two notches 40 adjacent the ends of the ridge 36. The base of the cap 38 includes a radially outwardly extending locking portion 39 located beneath the lip 34 which is adapted to extend into one of the notches 40 when the cap 38 is rotated by applying a torque A as shown in FIG. 1. In order to reach the notch 40, it is necessary to apply considerable torque A to the cap 38 so as to overcome the resistance offered by the ends 41 of the ridge 36 adjacent the notches 40. Once this resistance is overcome, the locking portion 39 snaps into place within one of the notches 40.

It will be understood that the notches 40 and the locking portion 39 are particularly important in the opening sequence for the closure. In this connection, it will be observed that the cap 38 includes an opening tab 44 which extends radially outwardly therefrom. The tab 44 is normally located above a pedestal 46 which extends radially outwardly from the neck 30 above the flange 20. By applying the torque A to the cap 38, the tab 44 is moved to a position circumferentially spaced from the pedestal 46 so as to allow a finger or thumb to be inserted beneath the tab 44. Once the finger or thumb is beneath the tab 44, the axially upwardly directed force B may be applied to the cap so as to push or pull the ridge 36 of the cap upward over the lip 34 of the closure base.

In the prior art closure-container combination of FIGS. 2 and 3, the closure 14 is secured to the container by inserting a curl 48 at the edge of an opening 50 in the panel 12 into the groove 24 of the closure 14. As shown, the curl 48 extends upwardly and radially outwardly such that the edge of the curl is not in contact with the radially outwardly facing surface 28 of the groove.

It has been found that the curl 48 is easily damaged during insertion of the closure 14 into the groove 24 of the closure. Such damage can result in a leaky contaner. Furthermore, the curl 48 is not effective to provide a centering function during the insertion of the closure 14 nor can it effectively resist removal of the entire closure fitment.

Another prior art container-closure combination is disclosed in U.S. Pat. No. 3,128,900 - Chaboche. As shown in FIG. 3a thereof, a curl or bead extends upwardly into a groove formed in a closure. Unlike the bead of the prior art container shown in FIGS. 2 and 3, the bead of the Chaboche container extends upwardly and then downwardly and inwardly. There is no suggestion that the edge of the curl is in contact with or in any way bitingly engages the closure.

SUMMARY OF THE INVENTION

It is an object of this invention to provide an opening in a metal container capable of resisting removal of a closure fitment associated therewith.

It is a further object of this invention to provide an opening in a metal container which will not be damaged during insertion of the closure fitment into the container.

It is a still further object of this invention to provide an opening in a metal container which will assist in centering the closure fitment during assembly on the metal container.

In a particularly preferred embodiment of the invention, a plastic closure fitment is inserted into an opening in a metallic member of a metallic container constructed in accordance with this invention. The plastic closure fitment comprises an annular portion extending generally downwardly in a direction substantially parallel to the axis of the closure and has a radially outwardly extending protuberance. A flange extends radially outwardly from the annular portion above the protuberance and has a downwardly extending projection spaced radially inwardly from the annular portion so as to form an annular groove between the radially inwardly facing surface of the downwardly extending projection and a radially outwardly facing surface of the annular portion above the radially outwardly extending protuberance. An annular neck extends from the flange and beneath the annular portion and has a dispensing opening at the upper end thereof. A cap removably covers the dispensing opening where the cap and the neck include means responsive to the sequential application of torque about the axis of the closure and an axially directed force to remove the cap from the dispensing opening. The metallic member of the opening constructed in accordance with this invention extends above the metallic member and into the groove of the plastic closure fitment with the radially innermost portion of the bead in biting engagement with the annular portion of the closure at the protuberance.

In order to provide the biting engagement, the radially innermost portion of the curl comprises a burr which engages the annular portion of the fitment at the protuberance. A substantial portion of the radially inwardly facing surface of the groove is inclined at an angle less than 10° with respect to the axis and the bead includes a radially outwardly facing surface adjacent the panel juxtaposed to the radially inwardly facing surface and inclined at an angle of less than 10° with respect to the axis.

In one preferred embodiment of the invention, the uppermost extremity of the bead is contacted by the flange. In another preferred embodiment of the invention, the metallic member is contacted by the flange radially outwardly from the bead.

In accordance with another important aspect of the invention, the closure-container combination described in the foregoing is made by piercing an initial opening in a metallic portion of the container from one side to the other side thereof so as to form a burr at the edge of said initial opening at the other side of the metallic portion. The edge of the metallic portion adjacent the opening is then formed so as to have a bead such that the burr is located at the radially innermost portion of the bead. The bead is then inserted into the groove such that the burr biting engagement the closure at the radially innermost side of the groove adjacent the protuberance. Preferably, the steps of piercing and forming the edge of the opening are done in rapid succession by a compound die.

BRIEF DESCRIPTION OF THE DRAWINGS p

DETAILED DESCRIPTION OF THE PREFERRED EMBODIMENTS

Figure 3:
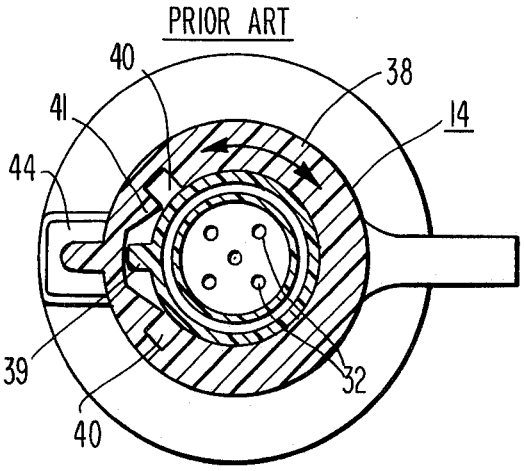
FIG. 3 is a sectional view of the closure of FIG. 2 taken along section line 3—3 thereof.
Figure 1:
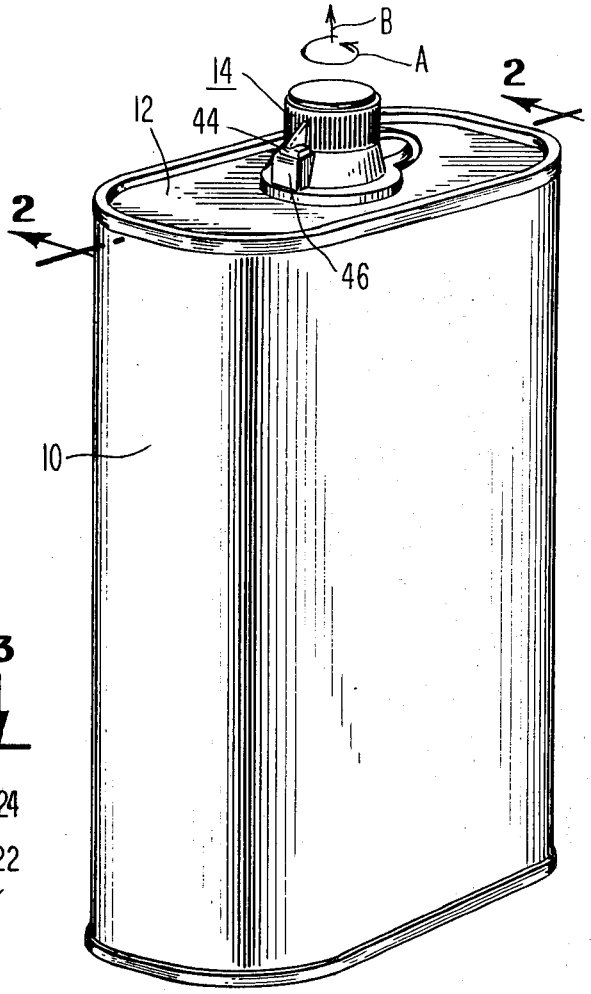
FIG. 1 is a container-closure combination of the type which forms the subject matter of this invention.
Figure 2:
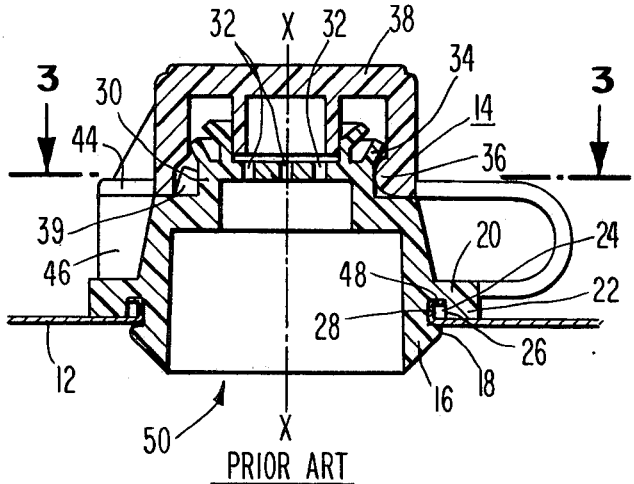
PRIOR ART Fig. 2
FIG. 2 is a sectional view of the previously discussed prior art container-closure combination taken along section line 2—2 of FIG. 1.
Figure 4:
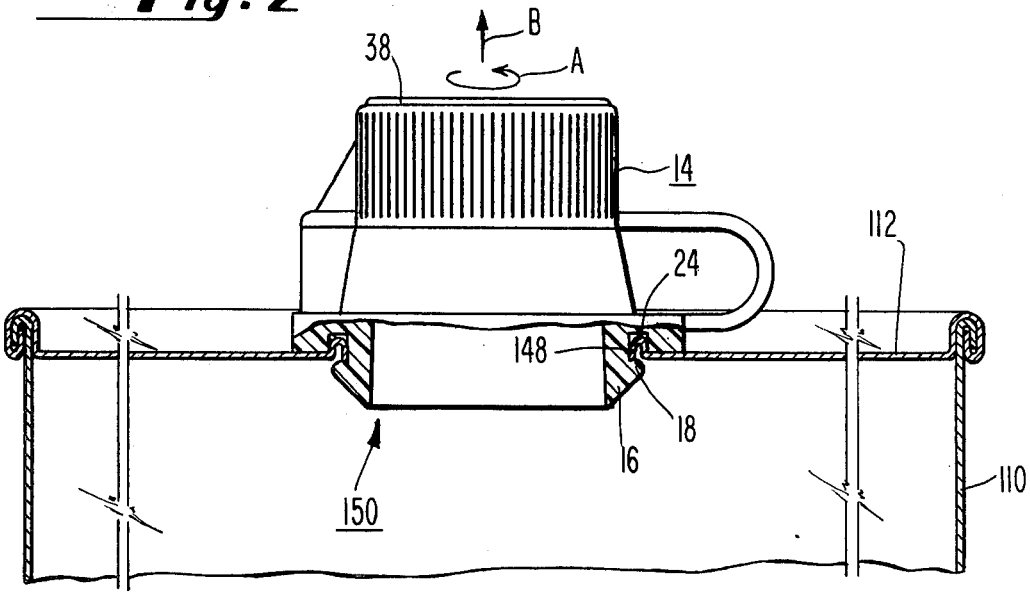
FIG. 4 is a sectional view of a container-closure combination representing a preferred embodiment of the invention.

Referring to FIG. 4, a plastic, child-proof closure fitment 14 of the type shown in FIGS. 1–3 is inserted into the uppermost metallic panel or portion 112 of the container 110. The panel 112 includes an opening 150 surrounded by a bead 148 which extends initially upwardly into the groove 24, then radially inwardly and then downwardly so as to abradingly engage the annular portion 16 at or just above the protuberance 18.

It should be appreciated that, during opening of the cap 38, the considerable torque A does produce a tendency for the bead 148 to slide through the groove 24. Furthermore, the necessary force B to open the cap 38 tends to pull the protuberance 18 upwardly past the bead 148. However, it has been found that the particular construction of the bead 148, as will now be described in detail prevents any movement between or separation of the closure 14 from the panel 112.

Figure 5:
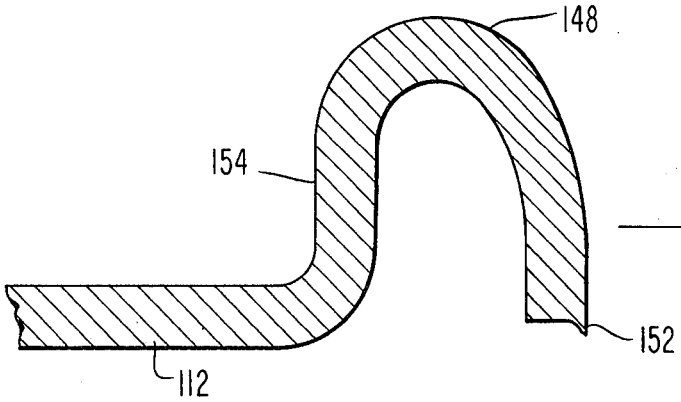
FIG. 5 is an enlarged partial sectional view of the bead at the opening in the container of FIG. 4.
Figure 6:
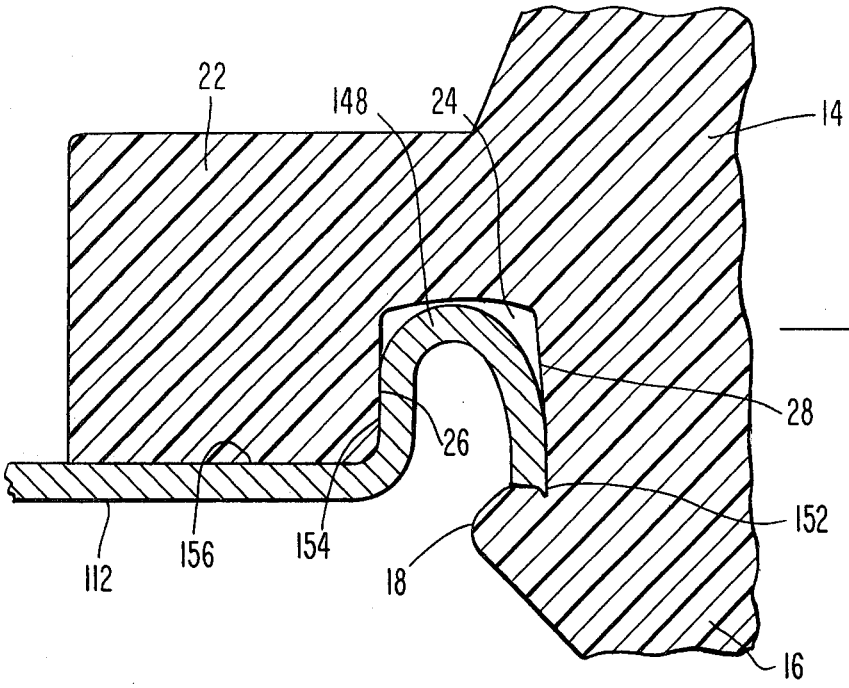
FIG. 6 is an enlarged sectional view of the container-closure combination shown in FIG. 4 for a preferred embodiment of the invention.

As shown in FIG. 5, the bead 148 includes a burr 152 at the lowermost, inwardly facing surface of the bead. As a result, the burr 152 bitingly engages the radially outwardly facing surface 28 of the groove 24 as shown in FIG. 6. As also shown in FIGS. 5 and 6, the radially outwardly facing surface 154 of the bead 148 extends at an angle of less than 10° with respect to the axis XX of the closure 14, and preferably parallel to the axis XX, over a substantial length thereof so as to substantially conform with the radially inwardly facing surface 26. This configuration of the bead 148 allows the radially inwardly facing surface 26 to apply pressure against the bead 148 along the surface 154 and thereby assist in forcing the burr 152 into biting engagement or contact with the closure 16.

As shown in FIG. 6, the burr 152 is also forced into biting contact with the annular portion 16 by the interference fit between the panel 112 and the flange 22 radially outwardly from the bead 148 along a surface 156. The interference fit along the surface 156 forces the burr downwardly into the protuberance 18 while the interference fit between the surface 154 and the bead forces the burr 152 radially inwardly into the annular portion 16.

Figure 7:
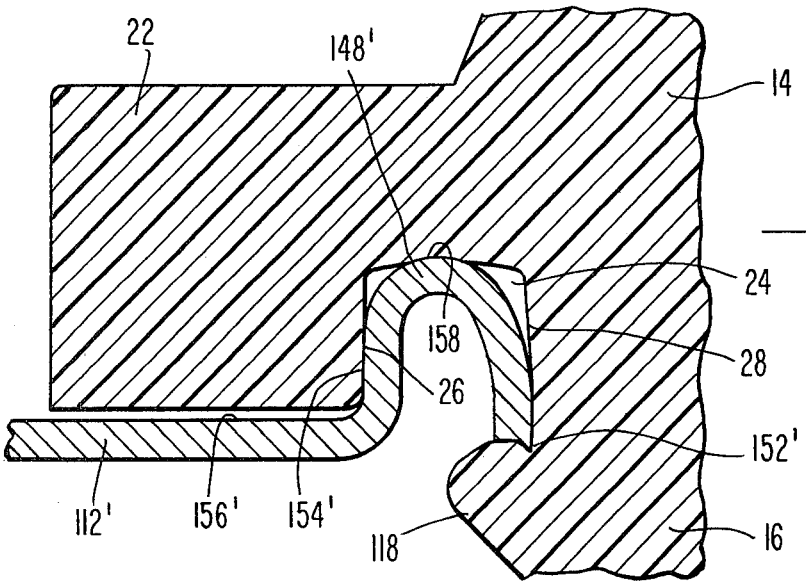
FIG. 7 is a sectional view similar to that of FIG. 6 for another embodiment of the invention.

In the embodiment of FIG. 7, the groove 24 is of the same configuration but the bead 148′ extends upwardly so as to contact or interfere with the base of the groove 24 at an uppermost surface 158. As in the embodiment of FIG. 6, the interference fit between the radially outwardly facing surface 154 of the bead 148′ and the radially inwardly facing surface 26 of the groove 24 extends substantially parallel to the axis of the closure so as to force the burr 152′ radially inwardly into biting contact with the annular portion 16. In addition, the interference fit at the uppermost surface 158 at the base of the groove 24 forces the burr 152 downwardly into biting contact with the protuberance 18 even though a space exists between a surface 156′ of the panel 112′ and the flange 22.

Figure 8:
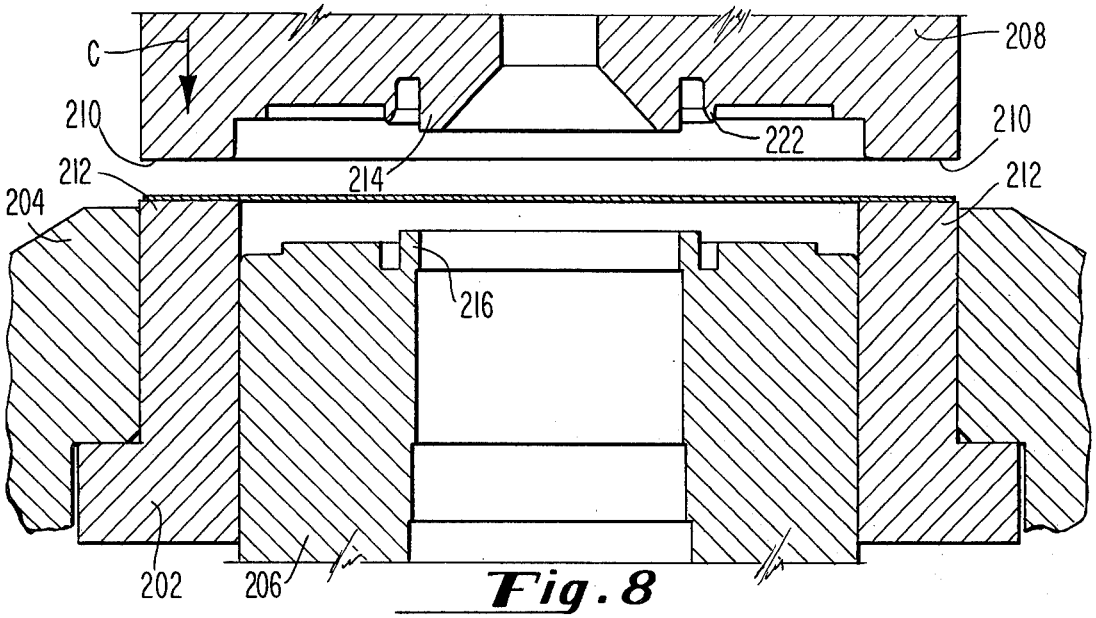
FIGS. 8–10 are sectional views showing the method and apparatus for forming the openings in the container of FIGS. 4–7.

The method for manufacturing the panel 112 as shown in FIG. 4 will now be described with reference to the method and apparatus disclosed in FIGS. 8–10. As shown in FIG. 8, a blank 200 is suspended across a compound die comprising a clamping portion 202 spring biased into the position shown in FIG. 8 against an outer die housing 204. An inner die member 206 is rigidly mounted with respect to the housing 204 spaced from the central portion of the flat blank 200 when an upper die member 208 is in the position as shown in FIG. 8.

Figure 9:
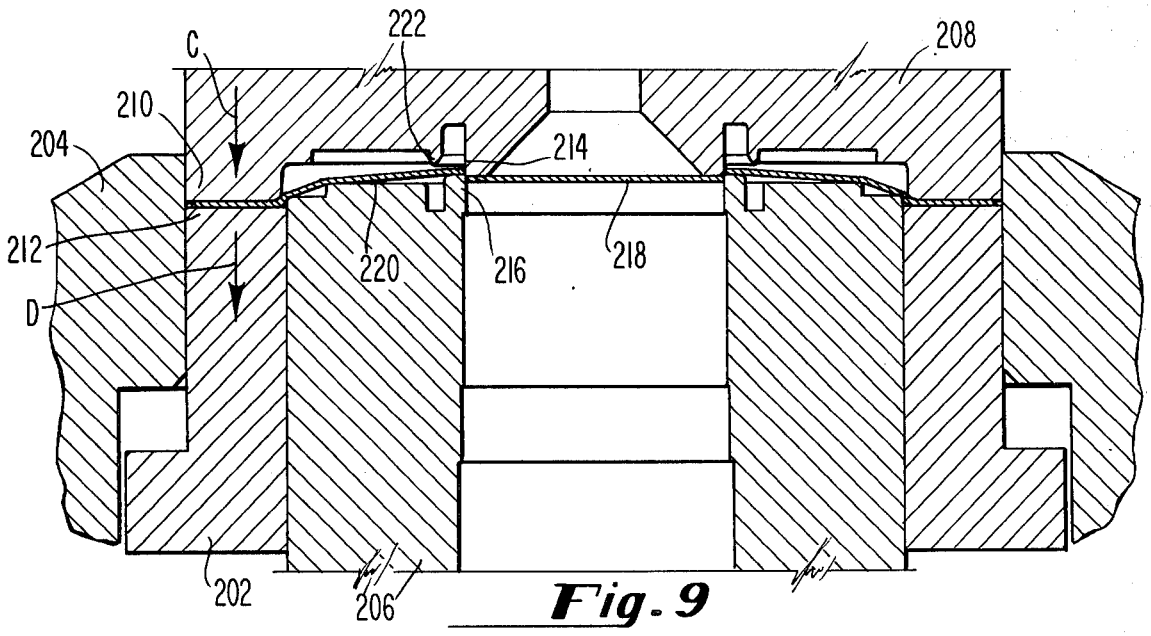
Figure 10:
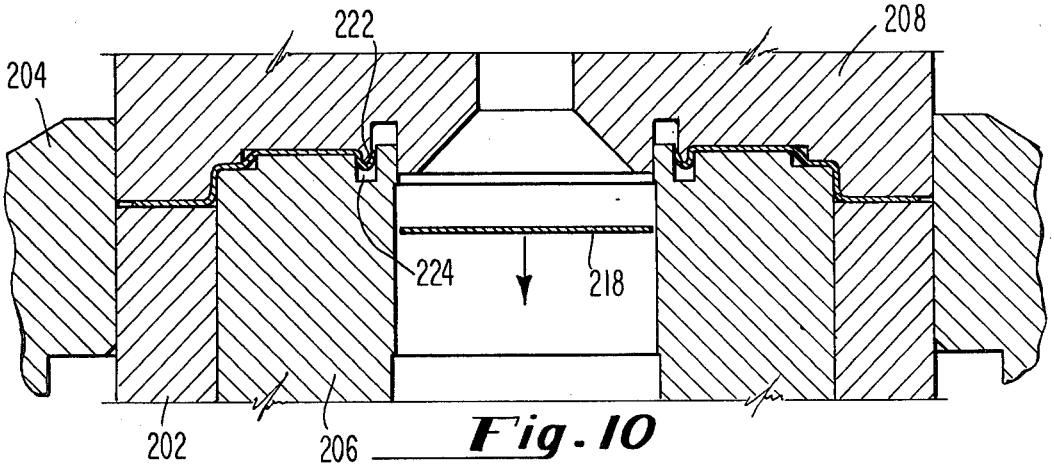

As the upper die member 208 descends as depicted by the arrows C in FIGS. 8 and 9, initial contact is made with the blank 200 between a clamping portion 210 of the upper die 208 and clamping portion 212 of the lower clamping member 202. Then, as the die 208 descends further with the clamping member 202 as indicated by the arrow D, contact is made between a punch portion 214 of the die 208 which cooperates with piercing portion 216 of the die 206 so as to sever a circular member 218 from the blank 200 as shown in FIG. 9 thereby forming an initial opening in the blank 200. At this point in time, the doming of the blank 200 has taken place by a pedestal 220 on the die 206. At the time the initial opening is formed by movement of the punch 214 from one side of the blank 200 to the other side of the blank, the burr 152 as shown in FIG. 5 is formed in the initial opening.

Subsequently, as the die 208 mates with the die 206, a bead forming projection 222 is inserted into the annular groove 224 so as to form the bead as shown in FIG. 5 with the burr at the radially innermost edge of the bead. It will thus be appreciated that the method and apparatus disclosed in FIGS. 8–10 provide for the piercing of the blank 200 so as to form an initial opening and the forming of a bead around the opening with a burr at the radially innermost edge in sequential operations capable of being performed in rapid succession. Accordingly, a low cost method apparatus for forming the panel 212 of FIG. 4 is provided.

The manufacture of the specific container-closure combination shown in FIG. 4 is readily completed by inserting the annular portion 16 down through the opening formed by the bead 148. In this connection, it has been found that the bead 148 is of particular assistance during this step of insertion since bead 148 provides a centering function for the closure 14 as contrasted with the lack of a centering function performed by the bead 48 in FIG. 3.

In the foregoing, the closure fitment 14 has been described as plastic. Suitable plastic materials for use in the closure 14 include polyethylene of the type sold commerically by E. I. duPont deNemours and Company under the trade designations "Alathon 2005" and "Alathon 2010."

Although specific embodiments of the invention have been shown, it will be understood that various modifications may be made without departing from the true spirit and scope of the invention as set forth in the appended claims.

What is claimed is:

1. An improved child-proof, closure-container combination comprising:

a plastic closure including an annular portion extending generally downwardly in a direction substantially parallel to the axis of the closure and having a radially outwardly extending protuberance, a flange extending radially outwardly from said annular portion above said protuberance and having a downwardly extending projection spaced radially outwardly from said annular portion so as to form an annular groove between the radially inwardly facing surface of said downwardly extending projection and a radially outwardly facing surface of said annular portion above said radially outwardly extending protuberance, an annular neck extending from said flange and said annular portion and having a dispensing opening at the upper end thereof, and a cap removably covering said dispensing opening, said cap and said neck including means responsive to the sequential application of torque about the axis of said closure and an axially directed force to remove said cap from said dispensing opening;

a metal container including a metallic member having an opening receiving said downwardly extending annular portion of said plastic closure, said metallic member having a bead extending above said metallic member at said opening and into said groove with the radially innermost portion of said bead extending generally downwardly and having a terminal edge in bitting engagement with said annular portion at said closure at said protuberance; and a substantial portion of said radially inwardly facing surface is inclined at an angle less than 10° with respect to said axis and said bead includes a radially outwardly facing surface adjacent said panel juxtaposed to said radially inwardly facing surface and inclined at an angle of less than 10° with respect to said axis.

2. The container-closure combination of claim 1 wherein said radially innermost portion of said curl comprises a burr in biting engagement with said annular portion at said protuberance.

3. The container-closure combination of claim 1 wherein the uppermost extremity of said bead is contacted by said flange.

4. The container-closure combination of claim 1 wherein said metallic member is contacted by said flange radially outwardly from said bead.

* * * * *

UNITED STATES PATENT AND TRADEMARK OFFICE

CERTIFICATE OF CORRECTION

PATENT NO. : 4,065,035

DATED : December 27, 1977

INVENTOR(S) : John C. Eissler

It is certified that error appears in the above-identified patent and that said Letters Patent are hereby corrected as shown below:

In the abstract, line 8, "fittingly" should read --bitingly--.

Column 2, line 5, after the word "cap" insert --38--.

Column 3, line 29, delete "biting engagement" and insert --bitingly engages--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*